US007779515B2

(12) United States Patent
DeMik et al.

(10) Patent No.: US 7,779,515 B2
(45) Date of Patent: Aug. 24, 2010

(54) TWO-PIECE CABLE TIE SUITABLE FOR USE IN AN AUTOMATED CABLE TIE INSTALLATION TOOL

(75) Inventors: Jonathan A. DeMik, Schererville, IN (US); James A. Brownlee, Minooka, IL (US); William A. Bernard, Darien, IL (US); Jerry V. Leanna, Mokena, IL (US)

(73) Assignee: Panduit Corp., Tinley Park, IL (US)

( * ) Notice: Subject to any disclaimer, the term of this patent is extended or adjusted under 35 U.S.C. 154(b) by 298 days.

(21) Appl. No.: 11/382,508

(22) Filed: May 10, 2006

(65) Prior Publication Data

US 2006/0254031 A1 Nov. 16, 2006

Related U.S. Application Data

(60) Provisional application No. 60/680,988, filed on May 13, 2005.

(51) Int. Cl.
*B65D 67/02* (2006.01)
*B65D 63/00* (2006.01)

(52) U.S. Cl. ..... 24/16 PB

(58) Field of Classification Search ..... 24/16 R, 24/16 PB, 17 A, 17 AP, 30.5 R; 248/68.1, 248/74.1–74.3

See application file for complete search history.

(56) References Cited

U.S. PATENT DOCUMENTS

| | | | |
|---|---|---|---|
| 3,186,047 | A | 6/1965 | Schwester, et al. |
| D205,940 | S | 10/1966 | Miller |
| 3,457,598 | A | 7/1969 | Mariani |
| 3,568,262 | A | 3/1971 | Woldman |
| 3,605,199 | A | 9/1971 | Eberhardt |
| 3,660,869 | A | 5/1972 | Caveney et al. |
| 4,001,898 | A | 1/1977 | Caveney |
| 4,183,119 | A | 1/1980 | Stewart et al. |

(Continued)

FOREIGN PATENT DOCUMENTS

| | | | |
|---|---|---|---|
| EP | 0681969 | A1 | 11/1995 |

(Continued)

*Primary Examiner*—Robert J Sandy
(74) *Attorney, Agent, or Firm*—Robert A. McCann; Christopher S. Clancy; James H. Williams

(57) ABSTRACT

A two-piece cable tie is provided that is capable of usage with an automated cable tie installation tool. The two-piece cable tie accommodates improved gripping of large or small bundles. By including a cored-out region near the neck, the cable tie can secure a near zero bundle size. By including a transverse pad on the bottom side of the cable tie strap near the cable tie head, the cable tie can be prevented from rotation relative to the bundle to which is it secured. A preferred cable tie strap has a wide recessed center section and high side rails that increase lateral clamping force. To resist barb inversion, the cable tie preferably includes a reinforcement area underneath the metal locking device when used with a strap having a recessed area. By maintaining relatively high side rails and a thin web section in the tip, the cable tie can achieve zero insertion force while maintaining sufficient strap rigidity and size to enable feeding of the strap through an automated cable tie installation tool.

5 Claims, 11 Drawing Sheets

U.S. PATENT DOCUMENTS 4,501,049 A * 2/1985 Adamson ..... 24/30.5 P
4,537,432 A * 8/1985 Meeks ..... 292/318
4,632,247 A 12/1986 Moody et al.
4,705,245 A 11/1987 Osada
4,735,387 A 4/1988 Hirano et al.
4,766,651 A * 8/1988 Kobayashi et al. ..... 24/16 PB
4,866,816 A 9/1989 Caveney
4,875,647 A 10/1989 Takagi et al.
4,919,373 A 4/1990 Caveney et al.
4,944,475 A 7/1990 Ono et al.
5,031,943 A * 7/1991 Scott et al. ..... 24/16 PB
5,112,013 A * 5/1992 Tolbert et al. ..... 248/74.3
5,123,686 A * 6/1992 Wenk ..... 24/16 PB
5,131,613 A 7/1992 Kamiya et al.
5,212,928 A 5/1993 Scott
5,267,373 A * 12/1993 Chisek ..... 24/16 PB
5,295,285 A 3/1994 Shely
5,317,787 A 6/1994 Fortsch
5,333,822 A * 8/1994 Benoit et al. ..... 24/16 PB
5,513,421 A 5/1996 Wells
5,517,727 A 5/1996 Bernard et al.
5,524,945 A * 6/1996 Georgopoulos et al. ... 24/16 PB
5,621,949 A 4/1997 Wells et al.
D389,051 S 1/1998 Caveney et al.
5,803,413 A * 9/1998 Benoit et al. ..... 24/16 PB
6,253,421 B1 * 7/2001 Kraus ..... 24/16 PB
6,279,203 B1 8/2001 Hundley et al.
6,473,942 B1 11/2002 Caveney et al.
6,484,367 B1 11/2002 Caveney et al.
6,526,628 B1 3/2003 Caveney et al.
6,530,126 B2 3/2003 Caveney et al.
6,560,822 B2 5/2003 Caveney et al.
6,578,239 B2 * 6/2003 Hatch ..... 24/16 PB
6,745,439 B2 6/2004 Brownlee et al.
6,751,828 B2 6/2004 Matschiner et al.
6,763,553 B2 * 7/2004 Hatch ..... 24/16 PB

FOREIGN PATENT DOCUMENTS

EP 0869076 A1 10/1998

* cited by examiner

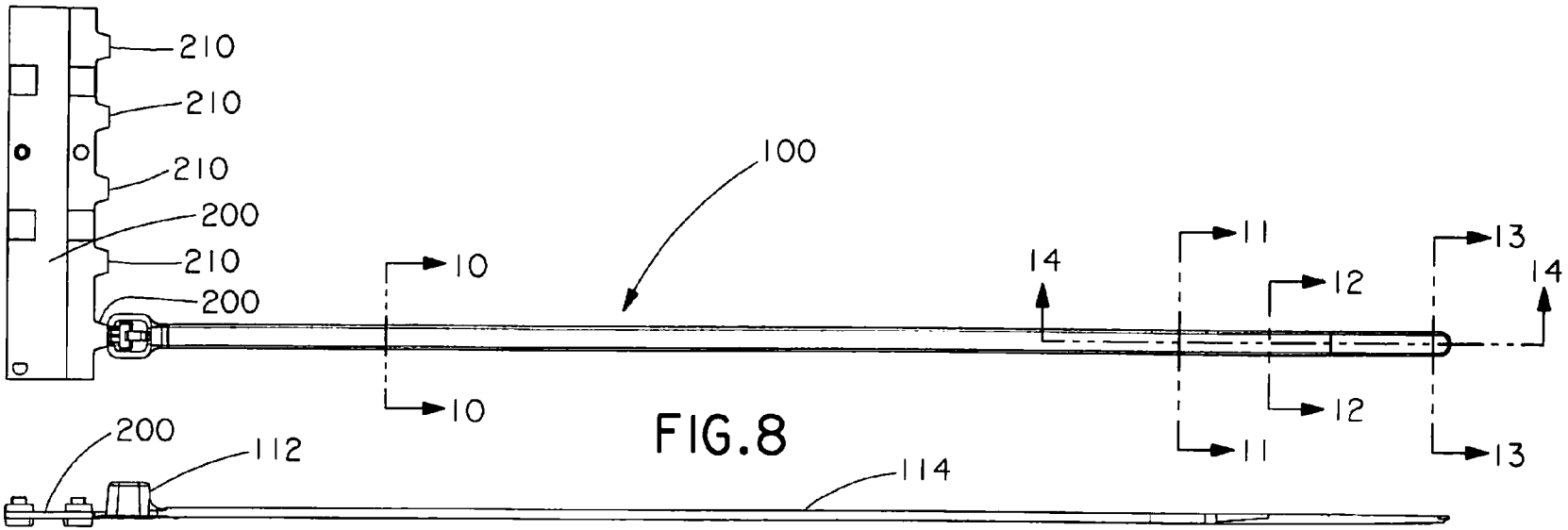
FIG. 8
FIG. 9
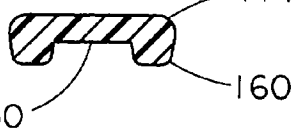
FIG. 13
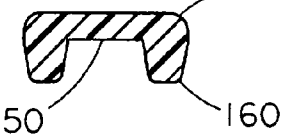
FIG. 12
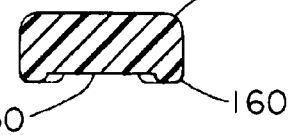
FIG. 11
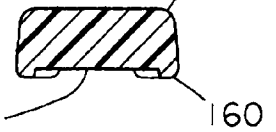
FIG. 10
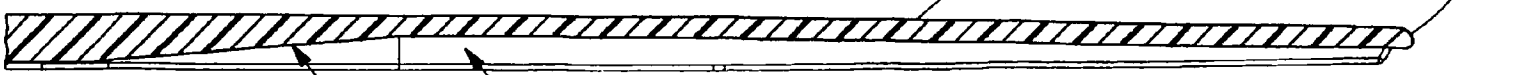
FIG. 14

TWO-PIECE CABLE TIE SUITABLE FOR USE IN AN AUTOMATED CABLE TIE INSTALLATION TOOL

CROSS-REFERENCE TO RELATED APPLICATION

This application claims priority to U.S. Provisional Application No. 60/680,988, filed May 13, 2005, the entirety of which is incorporated herein by reference.

BACKGROUND OF THE INVENTION

The invention relates to a two-piece barbed cable tie having improved bundling capabilities. The cable tie is suitable for use in an automated cable tie installation tool and can accommodate improved gripping of large or small bundles.

Plastic cable ties are well known in the art. There are two main types: one-piece plastic cable ties having an integral plastic locking device; and two-piece cable ties that incorporate a metal locking device insert. Examples of one-piece cable ties include U.S. Design Pat. No. D389,051 to Caveney et al. and U.S. Pat. No. 4,632,247 to Moody et al. Although most one-piece cable ties are manually assembled and tightened, certain versions can be used in an automated cable tie installation tool, such as the one disclosed in U.S. Pat. No. 4,632,247. Two-piece cable ties are primarily applied manually. Examples include U.S. Pat. No. 5,517,727 to Bernard et al., U.S. Pat. No. 3,457,598, U.S. Pat. No. 3,186,047 to Schwester et al., U.S. Pat. No. 6,560,822 to Caveney et al., and U.S. Pat. No. 3,457,598 to Mariani.

A representative low thread force conventional cable tie 10 of the two-piece type is shown in FIG. 1. Cable tie 10 is typically molded of thermoplastic to include a head 12 and a strap 14 as well as a number of standard features. Head 12 includes a strap accepting channel 18 defined by inner and outer walls. A metal locking device 22 is partially embedded at an angle within a barb receiving channel 20 of the cable tie head. The metal locking device 22 is situated at an angle so as to allow the tail end of strap 14 to be inserted through the strap accepting channel 18, but engaging the strap as it is pulled in a removing direction to prevent removal of the strap. Sometimes, a pocket 24 is formed below the metal locking device 22 to allow the mounted end of the metal locking member to rotate slightly in a direction towards the strap accepting channel 18. This construction enables the cable tie 10 to be secured around a large bundle 30 of cables as shown. Typically, the strap 14 has a generally solid cross-section in order to improve strap strength. However, because of the specific configuration, this type of cable tie is not preferable for securely fastening a very small bundle of cables. It also is not preferable for use in an automated installation tool.

Another conventional two-piece cable tie 10 is shown in FIGS. 2A and 2B. This one differs from the one in FIG. 1 by having a low profile head 12 with a strap accepting channel 18 oriented in line with the narrow dimension of the head 12. Additionally, strap 14 is provided with a preformed and bent strap neck 13 at the transition between the head 12 and strap 14 that, when relaxed, orients the strap at about 90 degrees relative to the head 12 and perpendicular to strap accepting channel 18. Although the neck 13 has a widened and reduced cross section 15 in the middle of the neck width, the peripheral lateral edges remain with substantial thickness, providing considerable remaining resistance to bending of the strap at the neck 13. Additionally, the strap accepting channel 18 is opened up at the inlet end 25 so that the strap end can be received within the profile of head 12 as shown. With this construction, a fairly small bundle of wires or cables can be securely bundled. However, because of the prebend, the substantial remaining rigidity of the cable tie at neck 13, and the geometry of the strap accepting channel 18, there is a limit to how small of an area can be snugly cinched up by a fully tightened cable tie as shown in FIG. 2A. This configuration also is not preferable for use with an automated installation tool.

Conventional two-piece cable ties may have some disadvantages. In many two-piece cable ties, the metal locking device (barb) can become inverted if a sufficiently high removal force is applied to the strap. Such inversion causes cable tie failure and is undesirable. Additionally, it is often difficult to sufficiently tighten a two-piece cable tie around a bundle without the cable tie rotating relative to the bundle or slipping axially along the bundle.

Although automated tools for installation of cable ties are known, such automated tools have used specially designed one-piece cable ties, such as ones shown in FIGS. 3A and 3B. An example of such an automated tool is disclosed in U.S. Pat. No. 4,623,247 to Moody et al. In FIG. 3A, a ribbon 38 of one-piece cable ties 40 is shown. Each cable tie 40 is mounted at its head 42 to strip portions 44 by a tab 46. The ties 40 are equally spaced with each tie's medial longitudinal axis being in parallel and each tie forming a right angle with strip portion 44. The one-piece ties 40 include head 42, strap 48 and an integrally molded locking device 43 that mates with wedge-shaped teeth 45 provided along a substantial portion of the bottom side of strap 48 as shown in FIG. 3B.

FIG. 4 shows a known automated tool 30 that includes a dispensing mechanism 32, a conveyance mechanism 34, and a remote tool 36. Dispenser mechanism 32 accepts the ribbon 38 shown in FIG. 3A and sequentially dispenses individual ties 40 to conveyance mechanism 34. The conveyance mechanism 34 delivers the individual ties to remote tool 36. Remote tool 36 then positions each tie 40 around a bundle of wire, tensions the tie 40 to a predetermined tension, and severs the tail of tie 40.

SUMMARY OF THE INVENTION

There are many problems with conventional one-piece plastic cable ties used in automated tools. One problem is that the wedge-shaped teeth often break during automated clamping by the tool. This is particularly problematic when the cable ties are used in dry weather, which makes the cable ties brittle. The problem can be caused by the extremely fast clamping action by the automated tool, and by the associated high tensioning force applied to the cable tie by the tool. Another source of the problem is the abrupt stop of the cable tie after traveling at high speeds through the conveyance mechanism.

Another problem, particularly when using an automated installation tool, is ensuring a sufficiently low insertion force in the tip to enable the cable tie to be fed through the tool and have a strap end threaded through a strap accepting channel automatically without excessive resistance or binding.

Another problem, with or without use of an automated installation tool, is that traditional one-piece cable ties have limited loop tensile strength due to the use of a plastic locking device and the integrally formed wedge-shaped teeth, which reduce the cross-sectional thickness of the strap and cause inherent weaknesses in the design. Similar problems exist in many two-piece cable ties, which sometimes encounter an inversion of the barbed locking device during application of high withdrawal forces. There is a need for a stronger cable tie that would enable higher tension to be applied or maintained, either manually by hand-operated tools or by an automated installation tool.

Another problem with many conventional one-piece or two-piece cable ties in general is the inability of the cable tie to engage a bundle, such as loose wires, without slippage. This is particularly problematic because the underside of the strap is able to rotate about the bundle even when reasonably tightened. Cable tie straps can also slide laterally. Thus, there is a need for a cable tie that can be more readily secured to a bundle without slippage and without requiring excessive tightening of the cable tie.

Yet another problem with many conventional one-piece or two-piece cable ties is the inability to accommodate a diverse bundle size, particularly a very small bundle size. There is a need for a cable tie structure that enables the smallest of bundles to be securely fastened by the cable tie.

In accordance with various aspects, a two-piece cable tie is provided that is capable of usage with an automated cable tie installation tool.

In accordance with other aspects, a cable tie is provided that can accommodate improved gripping of large or small bundles.

In accordance with various other aspects, a cable tie is provided with a cored-out region near the neck to allow the cable tie to secure a near zero bundle size due to the strap being able to bend to substantially conform to the shape of the cable tie head.

In accordance with further aspects, a cable tie is provided with a protruding cross pad, preferably a single pad transversely located on the strap near the cable tie head, to increase gripping and resist cable tie rotation about a bundle. In preferred embodiments, the transverse pad has a shallow height and width so as to be able to fit between adjacent loose wires in a bundle to prevent rotation. Additionally, by making the transverse pad with a shallow height, the pad will not interfere with feeding of the cable tie through an automated cable tie installation tool.

In accordance with yet further aspects, a two-piece cable tie is provided with a substantially wide recess on the bottom side of the strap, defining lateral longitudinal rails, preferably with sharp edges. Upon tightening of the cable tie strap, the strap experiences a slight bowing of the recessed portion of the strap and a digging in of the longitudinal rails into the bundle. This increases the clamping force of the cable tie to resist lateral movement of the cable tie relative to the bundle.

In accordance with further aspects, a two-piece cable tie is provided with reinforcement under a metal barb area to resist barb inversion. By making the reinforcement coincide with a recessed portion of the strap, the strap accepting channel does not need to be increased in dimension to accommodate the reinforcement.

In accordance with additional aspects, a two-piece cable tie achieves a zero insertion force in the tip while maintaining sufficient strap rigidity and size to enable feeding of the strap through an automated cable tie installation tool by providing a thin center strap thickness near the end of the strap and sufficiently high side rails to maintain a cable tie height and profile that can be engaged by the tool.

BRIEF DESCRIPTION OF THE DRAWINGS

The foregoing and further objects, features and advantages will become apparent from the following description of preferred embodiments with reference to the accompanying drawings, wherein:

FIG. 8 is a top view of a planar ribbon of cable ties, in which only a single cable tie is shown for purposes of illustration;

FIG. 9 is a side view of the ribbon of cable ties of FIG. 8;

FIG. 10 is an enlarged cross-sectional view of the cable tie of FIG. 8 taken along lines 10-10;

FIG. 11 is an enlarged cross-sectional view of the cable tie of FIG. 8 taken along lines 11-11;

FIG. 12 is an enlarged cross-sectional view of the cable tie of FIG. 8 taken along lines 12-12;

FIG. 13 is an enlarged cross-sectional view of the cable tie of FIG. 8 taken along lines 13-13:

FIG. 14 is a partial cross-sectional view of the cable tie of FIG. 8 taken along lines 14-14 showing a ramping of strap thickness from a cable tie strap end toward the main body;

DETAILED DESCRIPTION OF EMBODIMENTS

Figure 5:
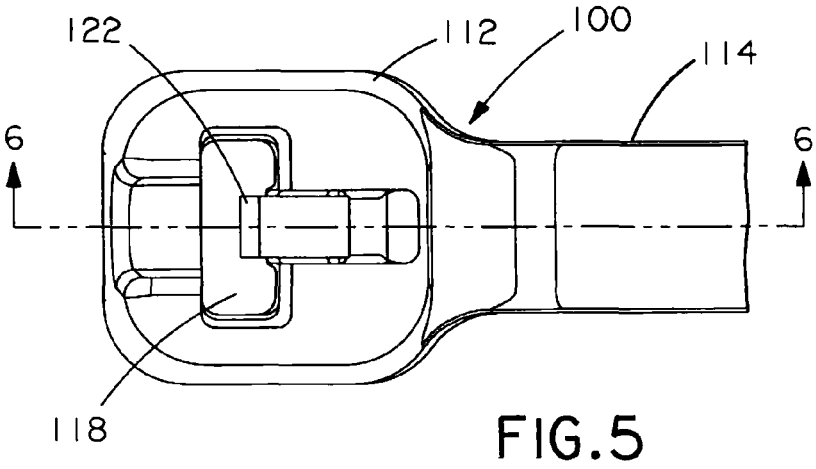
FIG. 5 is a partial top view of an exemplary two-piece cable tie.
Figure 6:
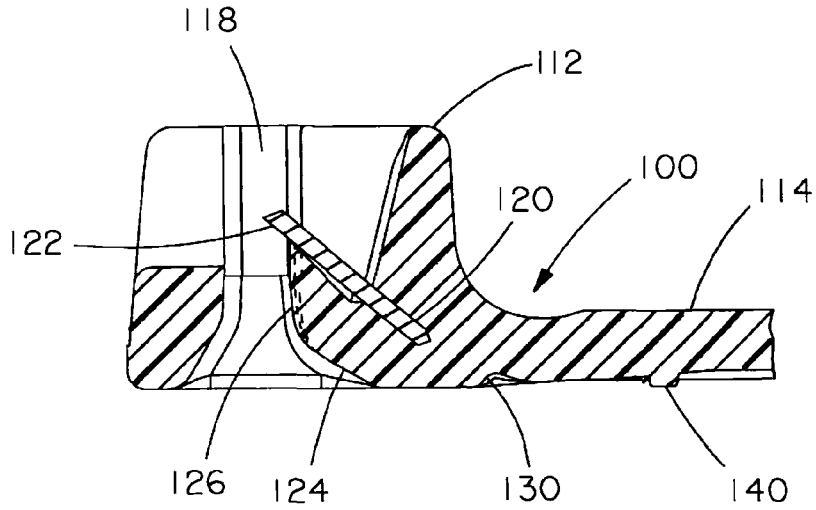
FIG. 6 is a partial cross-sectional view of the two-piece cable tie of FIG. 5 taken along lines 6-6.
Figure 7:
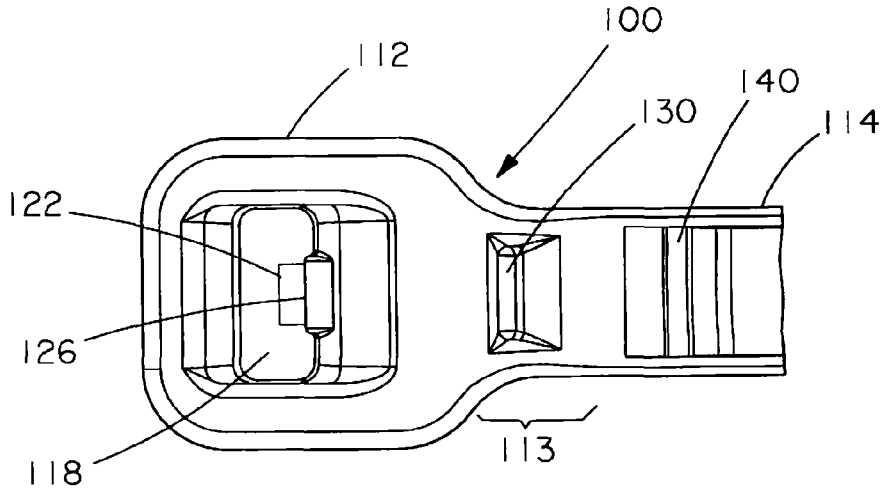
FIG. 7 is a partial bottom view of the exemplary two-piece cable tie of FIG. 5.

An exemplary embodiment of a two-piece cable tie suitable for use in an automated cable tie installation tool will be described with reference to FIGS. 5-15. FIGS. 5-7 show partial top, cross-sectional and bottom views, respectively, of an exemplary cable tie 100 having a head 112, strap 114, strap accepting channel 118, and a metal locking device 122 fixed in a locking device channel 120 so that an end of metal locking device 122 protrudes slightly into strap accepting channel 118. A reinforcement area 126 (best seen in FIG. 7) is provided immediately under the metal locking device 122. Reinforcing area 126 extends radially inward from the periphery of the strap accepting channel 118 to support an additional portion of the metal locking device and resist deformation or complete inversion of the metal locking device from excessive retraction forces applied to a cinched cable tie.

Figure 1:
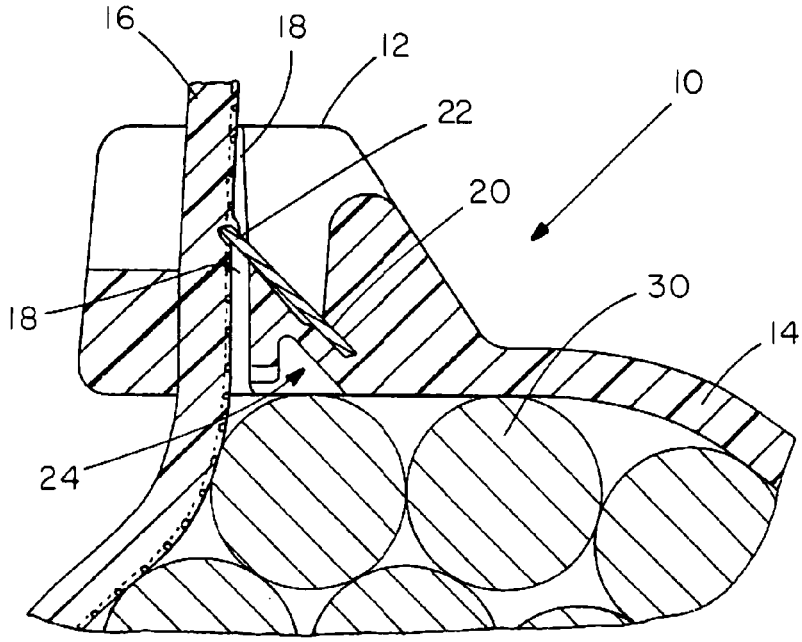
RELATED ART FIG. 1
FIG. 1 is a partial sectional view of a conventional two-piece cable tie in which a cable tie strap is wrapped around a bundle and secured in a locking head of the cable tie.
Figure 16:
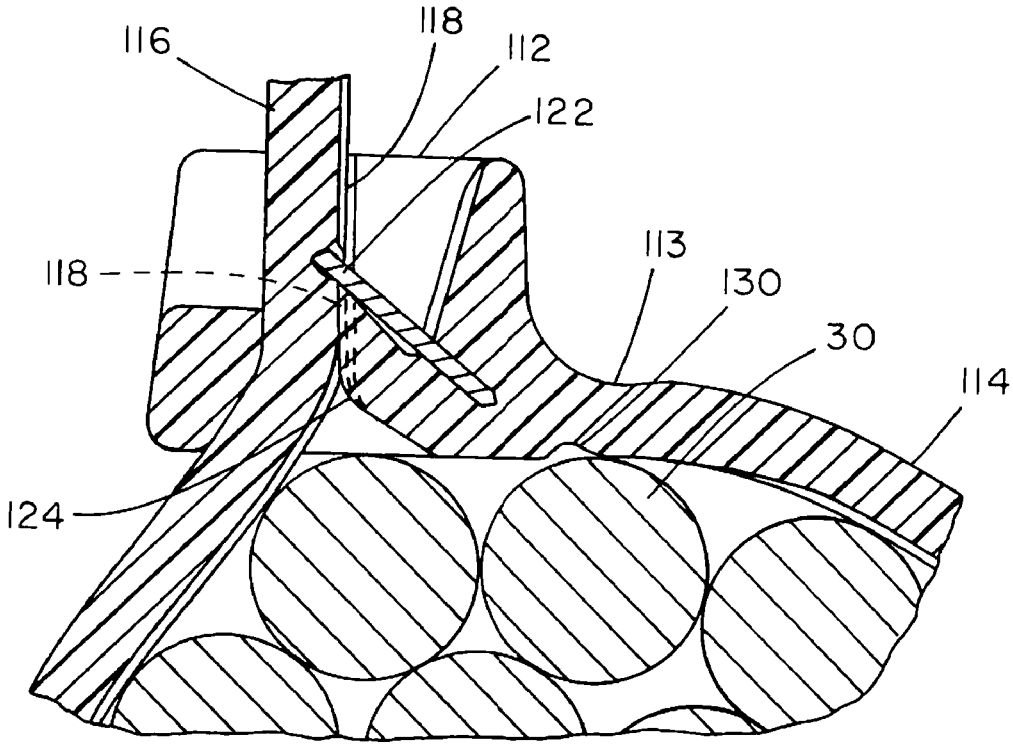
FIGS. 16-17 are partial sectional views of an exemplary two-piece cable tie having a cored-out neck region in which a cable tie strap is wrapped around a very large bundle and a very small bundle, respectively, and secured in a locking head of the cable tie.

Rather than the typical substantially square edge profile of the strap accepting channel 118 (as in FIG. 1), the exemplary strap accepting channel 118 includes a locking device support region 124 at an entrance to the channel that has a large radius. The purpose of the radius will be further described with reference to FIGS. 16-17.

In a neck region 113 between cable tie head 112 and strap 114 is a cored-out region 130 provided on an underside of the cable tie. This cored-out region 130 is provided in close proximity to cable tie head 112 and enables cable tie strap 114 to precisely buckle or bend at this location when a small bundle is being cinched. Additional details of the cored-out region 130 will be described later with reference to FIGS. 16-17.

A thin pad 140 protrudes from the under surface of the strap 114 at a position close to cable tie head 112, preferably at a position no further than a cable head width away. Pad 140 is oriented transverse to the length of the strap 114 and protrudes just a small distance outward from the surface. Pad 140 provides enhanced gripping when the cable tie is cinched around a bundle, particularly when a loose bundle of wires are being associated. Because pad 140 is able to fit between adjacent wires in the bundle, the cable tie can be locked in place to prevent rotation of the cable tie relative to the bundle. Moreover, by locating the pad near cable tie head 112, only a single pad is necessary to grip a large bundle or a very small bundle. Additional details of pad 140 will be described with reference to FIGS. 18-21.

Figure 4:
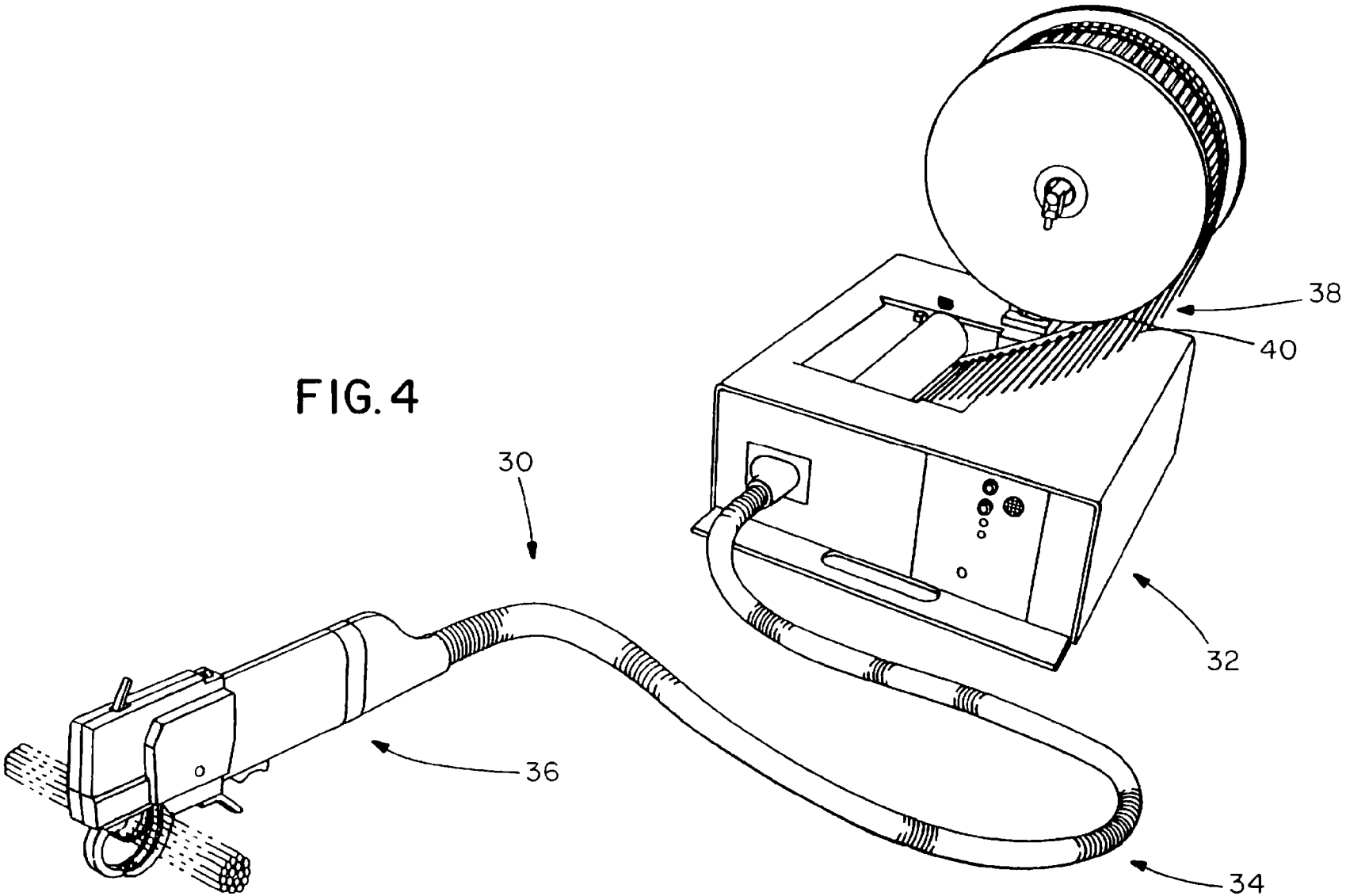
FIG. 4 is a perspective view of an exemplary automatic cable tie installation system for use with a cable tie ribbon.

Although cable tie 100 can be used manually as a conventional cable tie, cable tie 100 is also preferably configured to operate in an automated cable tie installation tool, such as the one illustrated in FIG. 4. Additional details of a suitable automated tool for installation of cable ties can be found in U.S. Pat. No. 4,623,247 to Moody et al. the disclosure of which is hereby incorporated herein by reference in its entirety. In such a use, cable ties 100 are molded onto a ribbon 200 as shown in FIGS. 8-9. In particular, each cable tie 100 is mounted at its head 112 to strip portions by a tab 210. The ties 100 are equally spaced with each tie's medial longitudinal axis being in parallel and each tie forming a right angle with the strip portion of ribbon 200.

Figure 3A:
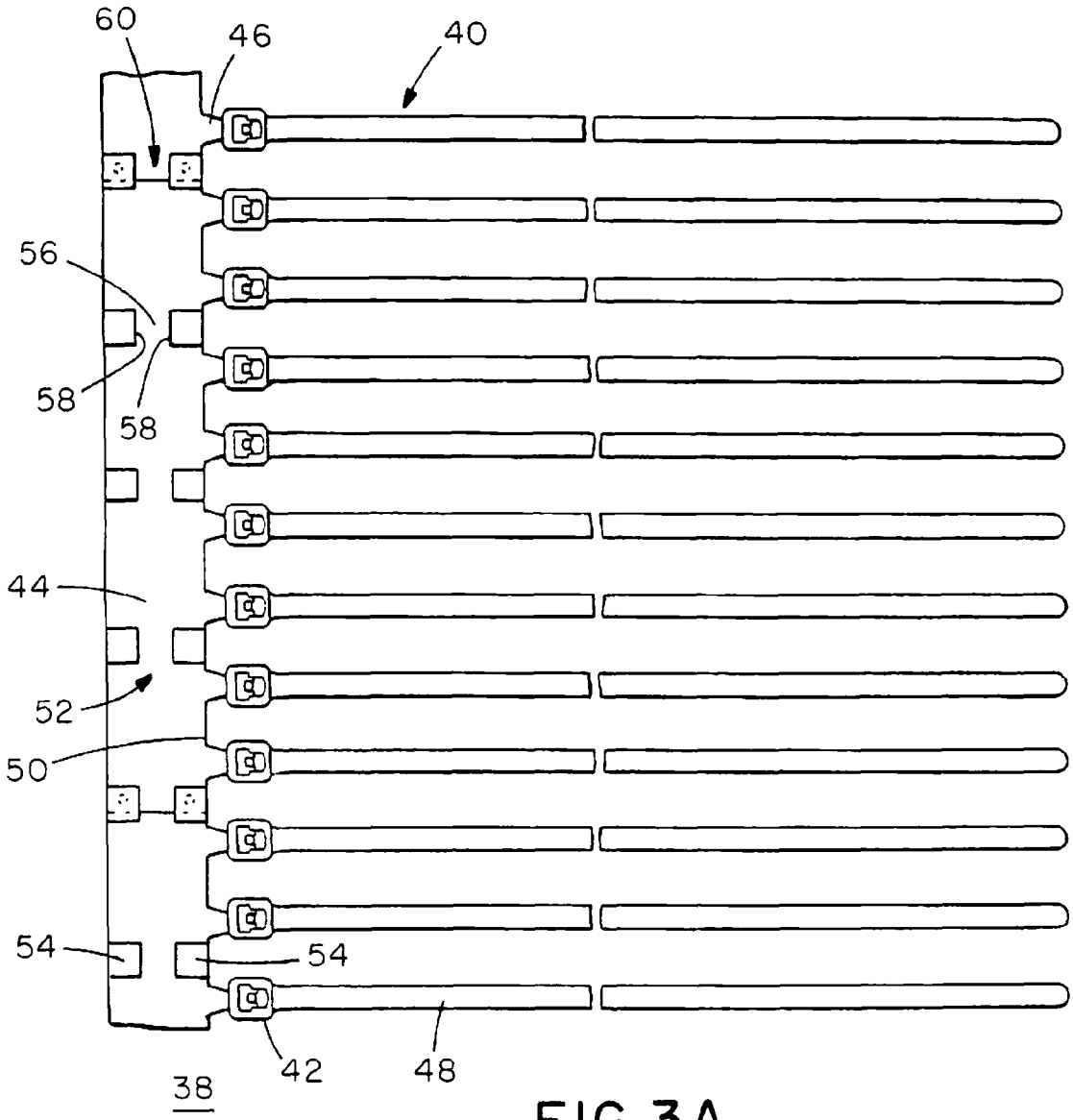
FIGS. 3A and 3B are top and bottom views, respectively, of a conventional one-piece cable tie having an integral locking member and strap teeth.

Cable tie 100 and ribbon 200 differ in many respects from the ribbon and cable tie assembly of FIG. 3A. A big difference is the use of a two-piece cable tie with a metal locking device 122. At least three key advantages are achieved by this.

Figure 3B:
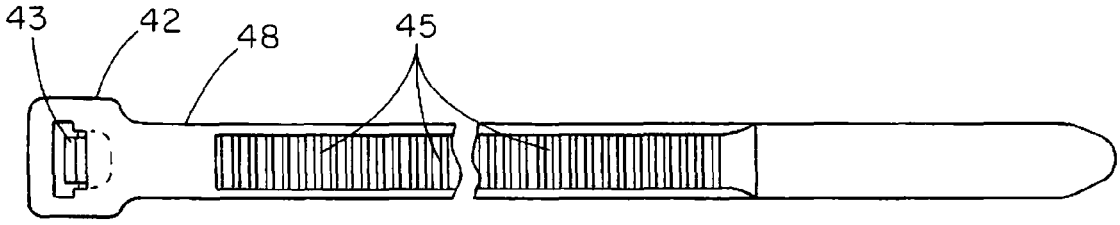

First, because the metal barbed locking device 122 can lock onto the cable tie strap at any position by digging into the surface of strap 114, there is no need for wedge-shaped teeth as in a conventional one-piece cable tie. The problem of loose bundles due to plastic wedge backlash is eliminated. Second, because there is no thin hinged plastic wedge (the steel barb is firmly anchored), there is no wedge breakage. Third, because the need for strap teeth is eliminated, the effective cross-section of the strap can be maintained or increased. That is, in prior automated one-piece cable ties such as the one shown in FIG. 3B, the teeth 45 are notched from the center section of the strap, reducing the effective cross-sectional area of the strap. However, the cross-section of strap 114 across a majority of its length has a cross-section as shown in FIG. 10 with only a shallow recessed area 150 and side rails 160. This provides an increased cross-sectional area, which provides for higher loop tensile strength, and enables the automated installation tool to be set with higher tool tension. Additionally, because the metal locking device 122 (barb) also has higher retention force, the exemplary two-piece cable tie can provide increased locking strength compared to a comparably sized one-piece cable tie.

FIGS. 10-15 show the tapering contour of the strap from near the neck towards a tail end 116 of strap 114. The contour is provided to produce a zero insertion force in the tip on the metal locking device of the cable tie when used in an automatic cable tie application tool. When the insertion force is too high on an automatic application tool, the tool cannot apply the cable tie properly. Accordingly, it is desirable to provide a low insertion force. However, the profile of the cable tie strap must also have sufficiently consistent size to allow for proper feeding of the strap into and through the tool. Additionally, the strap must retain sufficient rigidity.

In order to achieve these desirable characteristics, an exemplary cross-section is provided. FIG. 14 shows that the recessed area 155 increases along ramp 170 and then slightly decreases along the taper towards tip 116. As also shown from the various cross-sectional views, the total height of the strap 114 remains substantially constant until the taper, where the total thickness decreases. This constant height allows the cable tie strap 112 to be reliably gripped by an automatic cable tie installation tool.

In a preferred embodiment, the flat (center) recessed part 150 of the strap at the tail end of strap 114 (FIG. 13) has a web thickness of about 0.015", which is smaller than the distance between the end of the metal locking device 122 and the abutment wall of the strap accepting channel 118. This ensures that there is zero thread force when inserting the tip of strap 114 through the head 112. This low insertion force is desirable, particularly when the cable tie is used in an automated tool because if the insertion force is too high, the tool may not properly apply the cable tie. By making the end of the strap 114 very thin at the tip, the channel part of the strap easily threads past the metal locking device 122 without the metal locking device 122 catching on the tip and increasing strap insertion force.

However, rails 160 are high enough so that the total thickness of the tip (the combined thickness of the flat web portion and the rails) is about 0.028" at the smallest point near the end of the strap tip 116 (FIGS. 13-14). The rails 160 then preferably taper over a 0.5" distance until they reach a maximum height of 0.025" by themselves, making a total thickness of about 0.040" (FIG. 12). This total thickness is preferably the thickness of the main body of strap 114 at sections 10-10 and 11-11 (FIGS. 10-11). Rails 160 serve several purposes. First, they maintain a thickness to the strap near the outer extremity for a gripper gear in an automated tool to engage. Second, the rails 160 maintain a cross-sectional area for tensile strength in the tip of strap 114. Third, the rails 160 with a thin center section 150 (FIGS. 12-13) allow the strap tip to easily feed through the strap accepting channel 118 and metal locking device 122 with minimal threading force. Finally, the rails 160 maintain rigidity in the tip so that the tip does not buckle as it travels in the conveyance mechanism 34 and remote tool 36 of the automated installation tool.

Figure 15:
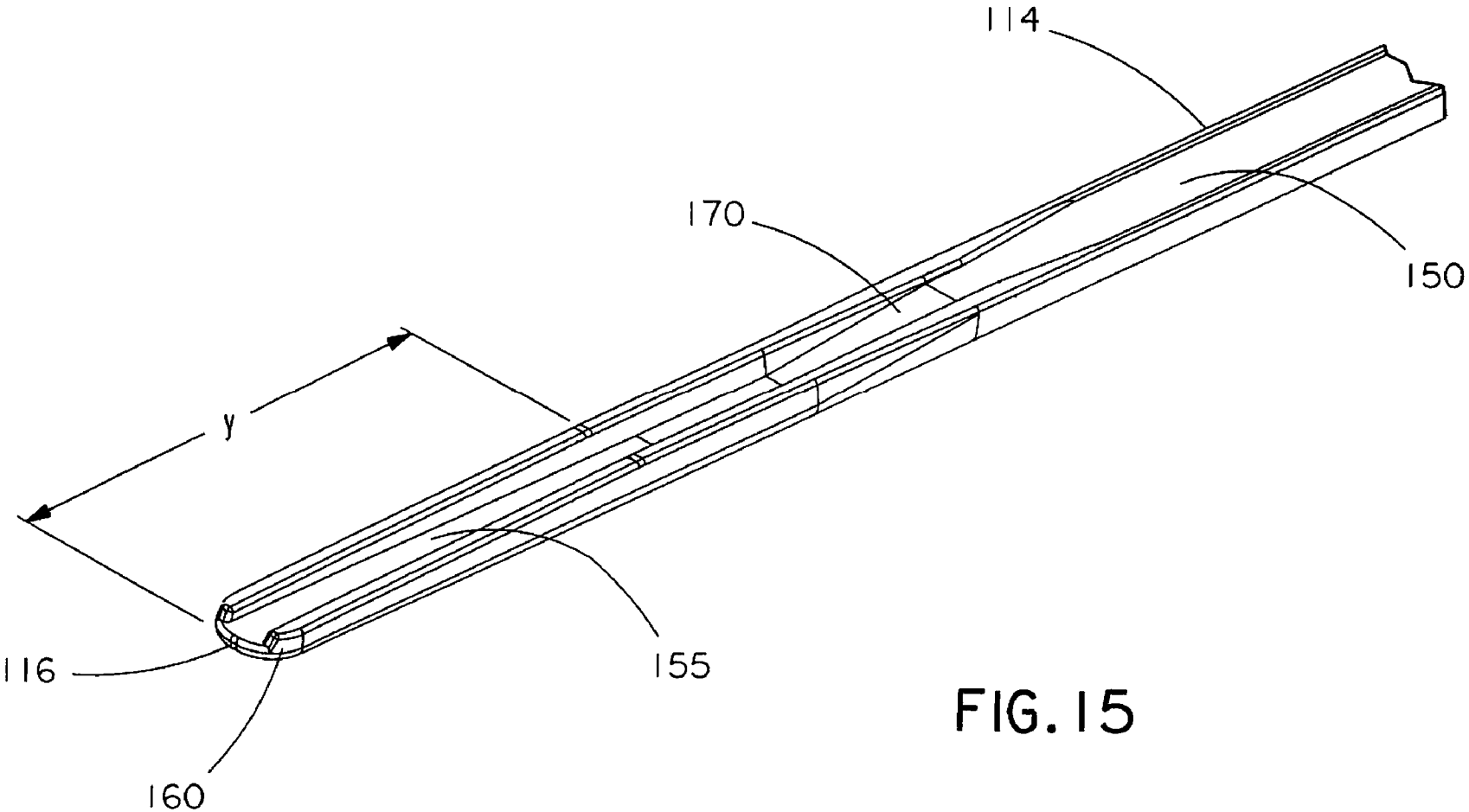
FIG. 15 is a partial bottom view of a tail end portion of an exemplary cable tie strap showing a tapered end profile.

As shown in FIG. 14 and better shown in FIG. 15, the flattest part 155 of the recessed area begins to thicken or ramp up at a predefined point about a distance Y from the tip. An increasing slope or ramp 170 slopes over a small distance from the thin tip thickness to a thicker strap body thickness (i.e., from the thickness in FIG. 13 to that in FIG. 12). In a preferred embodiment, Y is about 0.75" from the end of the strap. Therefore, when the tip 116 feeds through the head 112 during installation by an automated cable tie installation tool, the tip 116 will protrude from the top of the head by a predefined distance, preferably at least 0.62" so that the gripper gear in the automated tool can engage with the tip and pull it through until the strap tightens around the bundle. Although a preferred strap web thickness at the end of the tip is about 0.015", this thickness can vary depending on the cable tie head design.

As best shown in FIG. 14, the end of the tip 116 of strap 114 is rounded. This ensures that the cable tie can travel through the automated tool with no problems and without damaging the tool. In a preferred embodiment, the upper radius of the tip (FIG. 14) is about 0.010" while the lower radius of the web portion and rails is about 0.005" (FIGS. 13 and 14).

Figure 2A:
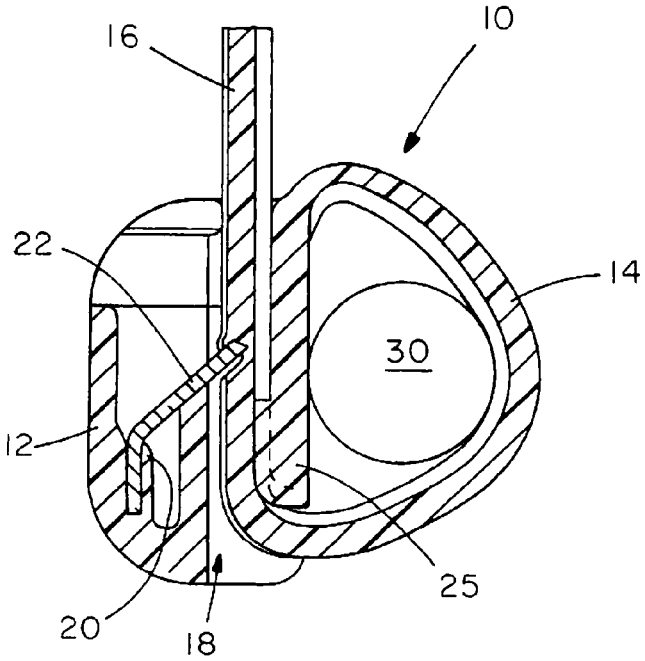
RELATED ART FIG. 2A
FIG. 2A is a sectional view of another conventional two-piece cable tie in which a cable tie strap is wrapped around a very small bundle and secured in a locking head of the cable tie.
Figure 2B:
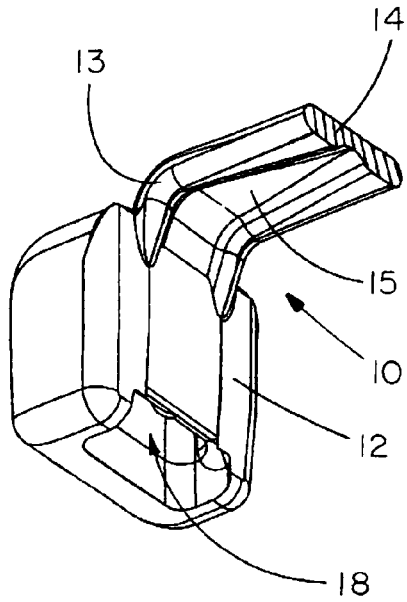
RELATED ART FIG. 2B
FIG. 2B is a partial perspective view of the cable tie of FIG. 2A in an original position having a prebent strap.

Miniature size cable ties are purchased by customers to be pulled around small bundle sizes. Some customers would like to be able to tie a cable tie to a single wire with a diameter of approximately 0.010" without the cable tie slipping after application. Prior cable ties were not capable of tightening to such a small diameter. Rather, prior cable ties such as those shown in FIGS. 1-2 retained a substantial free space or gap between a fully tightened strap and the cable tie head. An exemplary cable tie shown in FIGS. 16-17 addresses this problem by providing a cored-out region 130 near the neck 113 that allows the cable tie to secure a near zero bundle size. Additionally, the cored-out region allows for a predictable bending location that allows the cable tie strap to bend and collapse substantially against the bottom surface of the cable tie head leaving little or no gap to resist movement of the secured small bundle.

The neck region is the area of the strap 114 adjacent the cable tie head 112 that does not engage the locking device at a minimum bundle diameter. A zero bundle is achieved by forcing the cable tie to bend at a specified place and designing the bend and cable tie head profile to eliminate all or substantially all free space between the strap 114 and the bottom of the cable tie head 112.

Figure 17:
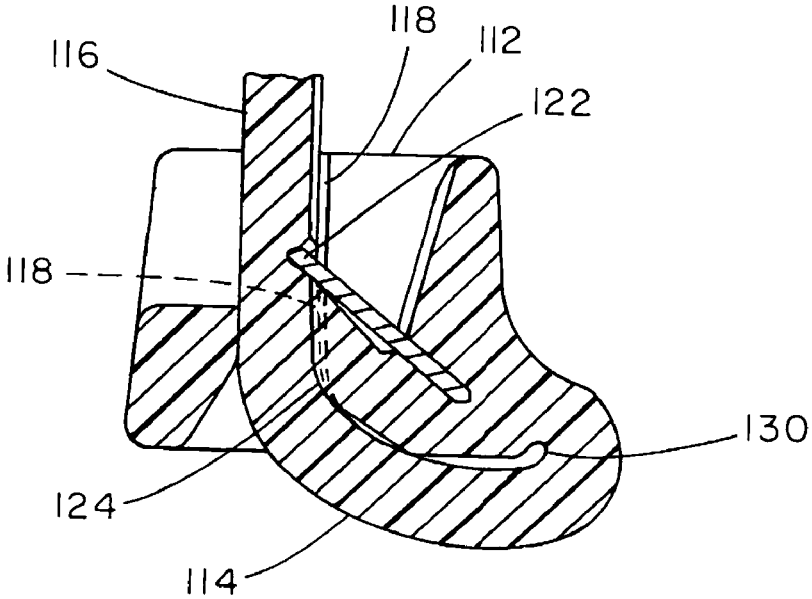

The cable tie strap will bend at the point of least resistance. By coring out the neck region very close to the cable tie head 112, the cable tie strap 114 can be made to bend at the lowest moment of inertia point. This alone may not be sufficient to ensure zero or near zero bundle capability. Many cable tie designs have a substantially square corner profile for the strap accepting channel 118. A strap cannot flow freely around this profile and may not be able to fully bend around this sharp corner. However, by providing a locking device support region 124 at the opening of the strap accepting channel 118 with a large radius, it is possible for the tightened strap 114 to flow more naturally into the channel 118 and to bend around this radius so as to leave minimal gaps as shown in FIG. 17. The increased radius at region 124 also allows for the cable tie strap to be pulled with higher tension without the corner cutting into or stretching the strap body. This improves or maintains loop tensile strength. Thus, the combination of a cored-out region 130 that controls a bend of the cable tie strap to be closely adjacent the neck and the provision of a large radiused strap accepting channel region 124 enable tightening of the cable tie strap to secure bundle diameters of approximately 0.010".

Another problem with cable ties is that they often rotate around a bundle once installed. This problem can occur with both large and small bundles and is particularly a problem with loose bundles, such as wires, which can change shape slightly. Prior attempts to solve this problem involved increasing cable tie tightness.

FIGS. 18-21 provide a protruding pad feature 140 that addresses this problem. A small, thin, and shallow protruding pad is located on an underside of the strap 114 near the neck. In preferred embodiments, the pad is positioned no more than the distance from the neck to the strap accepting channel 118 entrance. This ensures that regardless of whether the bundle is large or very small, the pad will be in contact with the bundle and will not be drawn into engagement with metal locking device 122.

Figure 19:
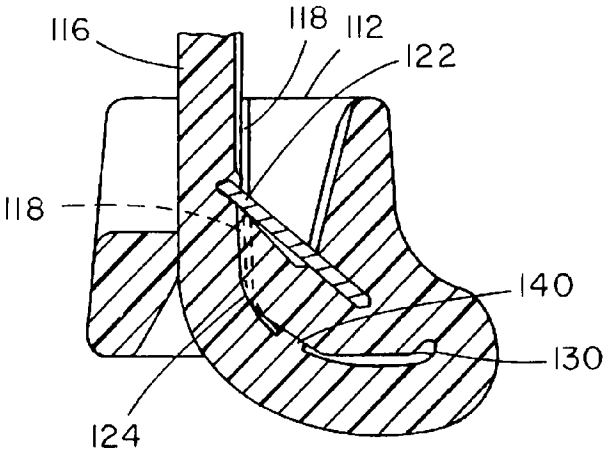
FIGS. 18-19 are partial sectional views of an alternative exemplary two-piece cable tie having a projecting pad in which a cable tie strap is wrapped around a very large bundle and a very small bundle, respectively, and secured in a locking head of the cable tie.
Figure 18:
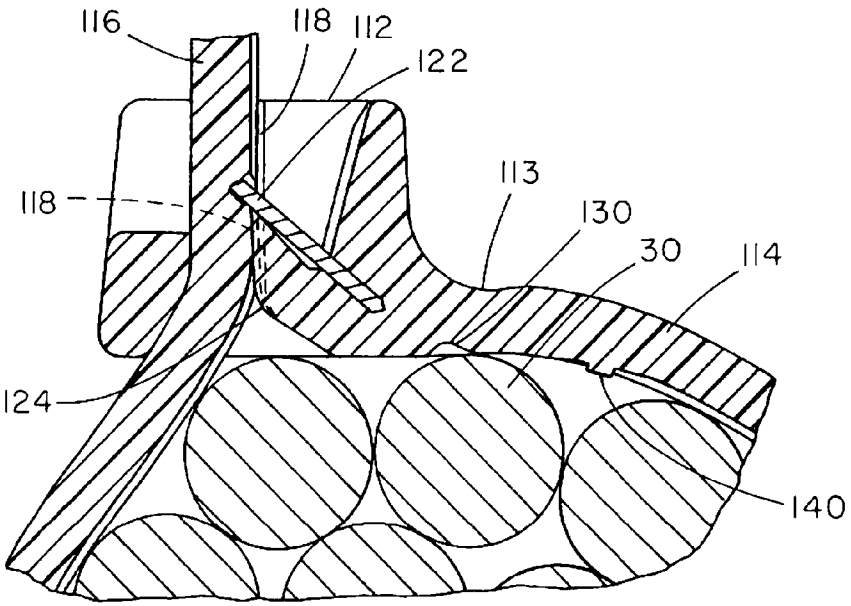
Figure 21:
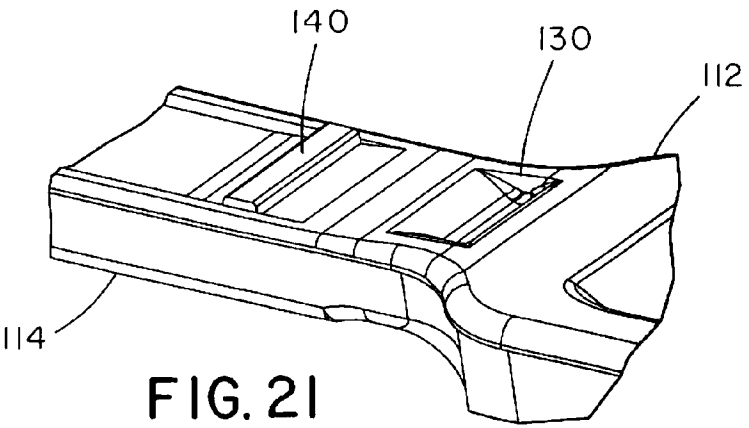
FIG. 21 is a partial perspective view of the pad region on the bottom side of the cable tie of FIG. 18.

As shown in FIG. 18, the protruding pad 140 is sized to extend between adjacent wires in a bundle. This may be achieved by making the pad extend transverse to the length of strap 114 as shown in FIG. 21 and by making pad 140 sufficiently narrow. When strap 114 is sufficiently tightened, pad 140 becomes wedged between adjacent wires in the bundle to prevent rotation of the cable tie relative to the bundle as shown. Moreover, pad 140 will also increase bundle tightness on even very small bundles as shown in FIG. 19. Pad 140 applies pressure on a wire when the cable tie is applied to the wire and acts to minimize remaining free space, preventing movement of the cable tie relative to the bundle.

Figure 20:
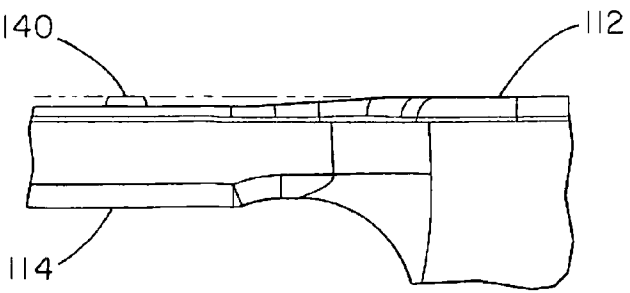
FIG. 20 is a partial side view of the pad region on the bottom side of the cable tie of FIG. 18.
Figure 22:
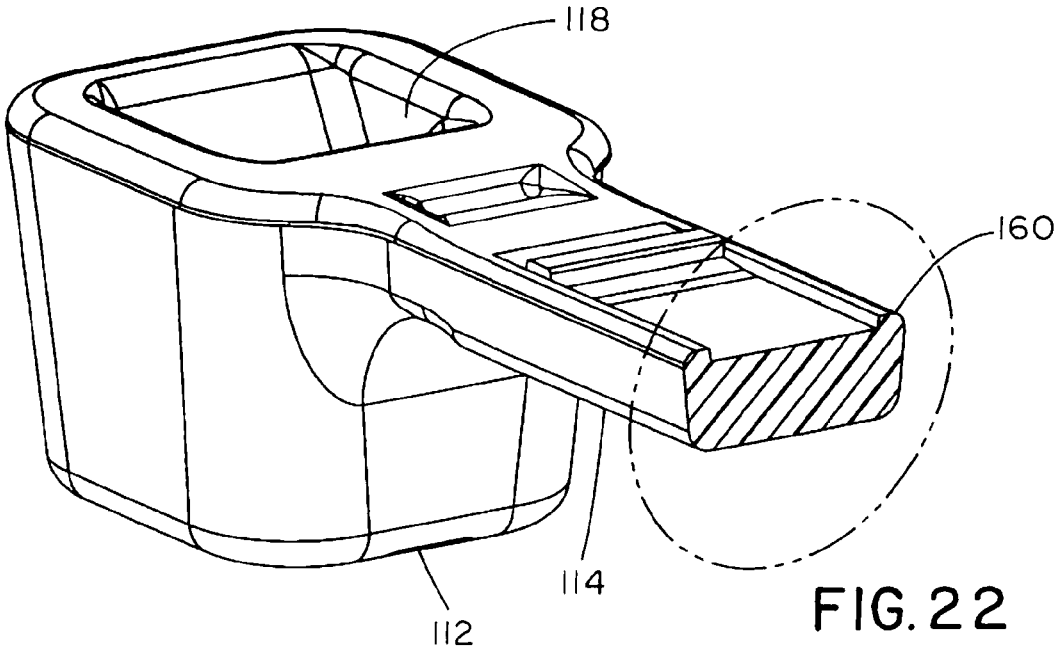
FIG. 22 is a partial perspective view of the cable tie of FIG. 8 showing strap cross-sectional detail.

When the two-piece cable tie is manually assembled and tightened, pad 140 can have various heights. However, if the cable tie is to be used in an automated installation tool, the pad needs to be sized to prevent binding or other problems with feeding of the cable tie in the tool. In an exemplary embodiment, this is achieved by making the height on the order of 0.035" to 0.040", which corresponds to the maximum dimension of cable tie head 112 as shown in FIG. 20. This allows the cable tie to smoothly travel through the automated cable tie installation tool without problems.

Additional bundle tightness to resist cable tie rotation, increase lateral force, and prevent lateral movement is achieved by making the strap profile have lateral edges that dig in or grip the bundle. This is better shown with reference to FIGS. 22-25. Many conventional two-piece cable ties have a substantially flat bottom strap surface to maximize cross-sectional area and loop tensile strength. However, by making rails 160 that extend along the lateral edges of the strap 114, and by providing a slightly recessed central section, these rails 160 can improve gripping strength by digging into the bundle when tightened.

The tighter the tie is on a bundle, the higher the resistance to lateral movement will be. By reducing the cross-section of the middle section of the strap slightly (wide recess 150), when the cable tie is tightened around specific bundle sizes, the middle of the cable tie strap bows toward the bundle as shown in FIG. 25 and the rails 160 become pressed tightly against the bundle.

Figure 23:
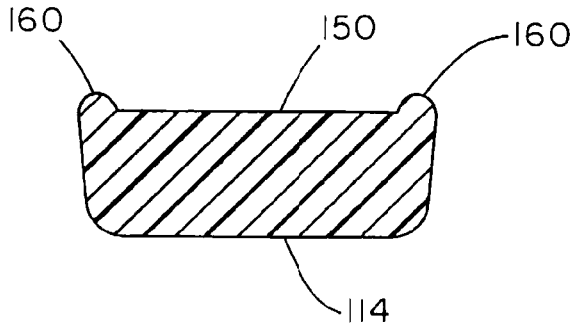
FIG. 23 is a cross-sectional view of the cable tie strap of FIG. 22 according to a first embodiment.
Figure 24:
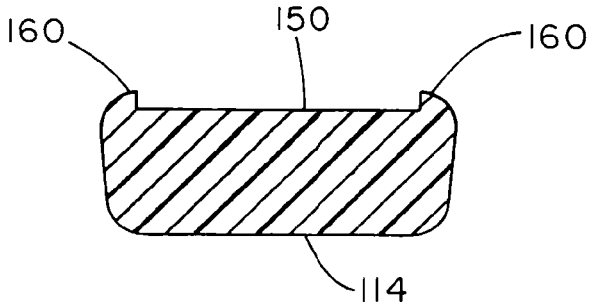
FIG. 24 is a cross-sectional view of the cable tie strap of FIG. 22 according to a second embodiment.

Two different embodiments are contemplated. When the bundle may be excessively soft or brittle (or for other reasons), the edges of rails 160 may be rounded as shown in FIG. 23 to minimize abrasion of the bundle or cutting of critical cable insulation. However, for maximum tightness it may be desirable to provide the rails with sharp edges, at least on the interior edges, as shown in FIG. 24. This will allow the rails 160 to dig into the bundle surface.

Figure 25:
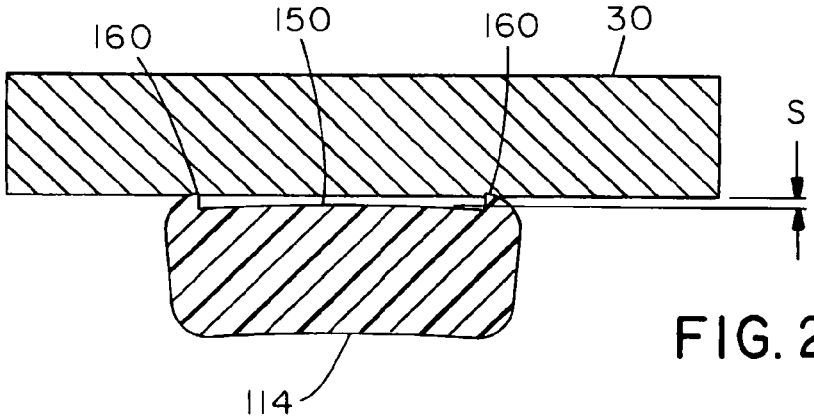
FIG. 25 is a partial cross-sectional view of the cable tie strap of FIG. 22 tightened to a bundle.

It is important for the recess to be sufficiently wide and the strap sufficiently thin so that the strap 114 is able to undergo bowing when tightened under load as shown in FIG. 25. It is also important that the recess not be overly deep or overly shallow. It is preferred that the recess be sized so that under load, the center of the bow maintains a small space between the bow and the bundle so that the rails remain in contact with the bundle to dig into the bundle surface and provide resistance to lateral movement.

Figure 26:
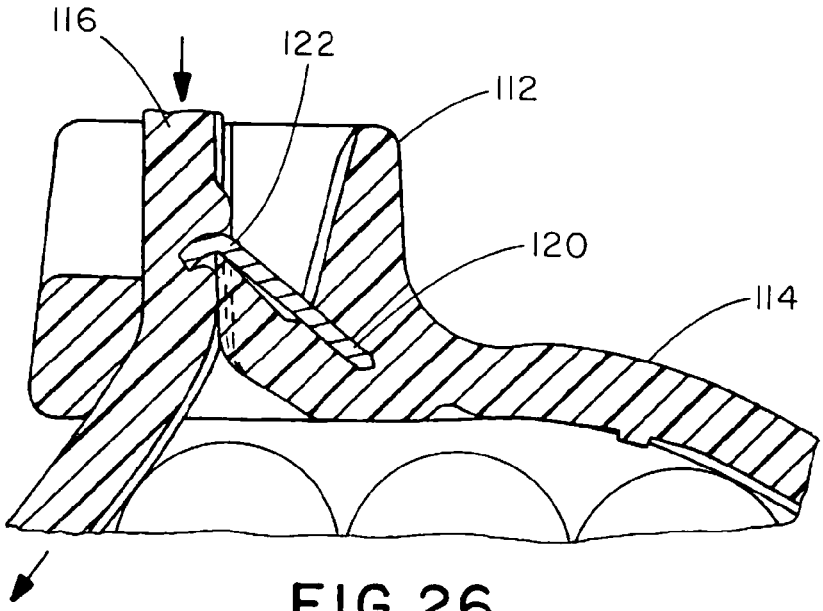
FIG. 26 is a partial cross-sectional view of a conventional two-piece cable tie when a removal force exceeds metal barb strength.

Conventional two-piece cable ties often exhibit a failure due to excessive pulling or withdrawal forces being applied to the cable tie strap. As shown in FIG. 26, this excessive force may cause the metal locking device (barb) 122 to invert backwards, causing failure of the cable tie and loss of strap tension. In order to maximize tensile strength, there should be as much support under the metal locking device as possible without compromising other features of the cable tie design.

Figure 27:
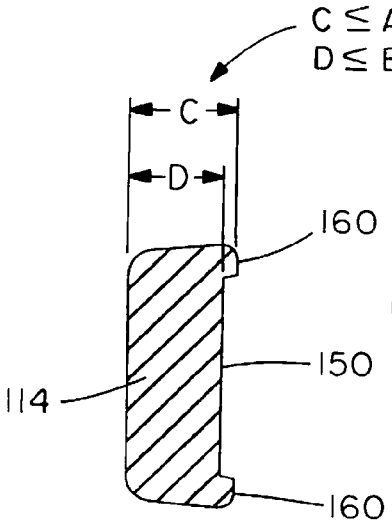
FIG. 27 shows a cross-sectional view of the cable tie strap at a main body portion.

When a solid cross-section strap is provided, this problem is not as prevalent because the metal locking device can be supported. However, when using a strap 114 having a recessed portion 150 as shown in FIG. 27, there becomes extra space between the supported part of the metal locking device and the strap.

Figure 28:
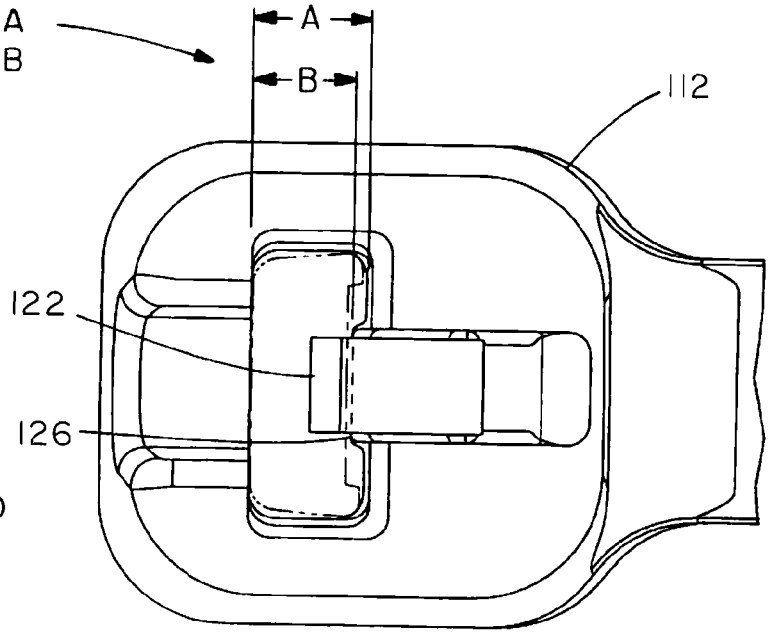
FIG. 28 shows a top view of the cable tie head of FIG. 27 with the cable tie strap superimposed to represent the fitting relationship between the strap accepting channel and the cable tie strap.
Figure 29:
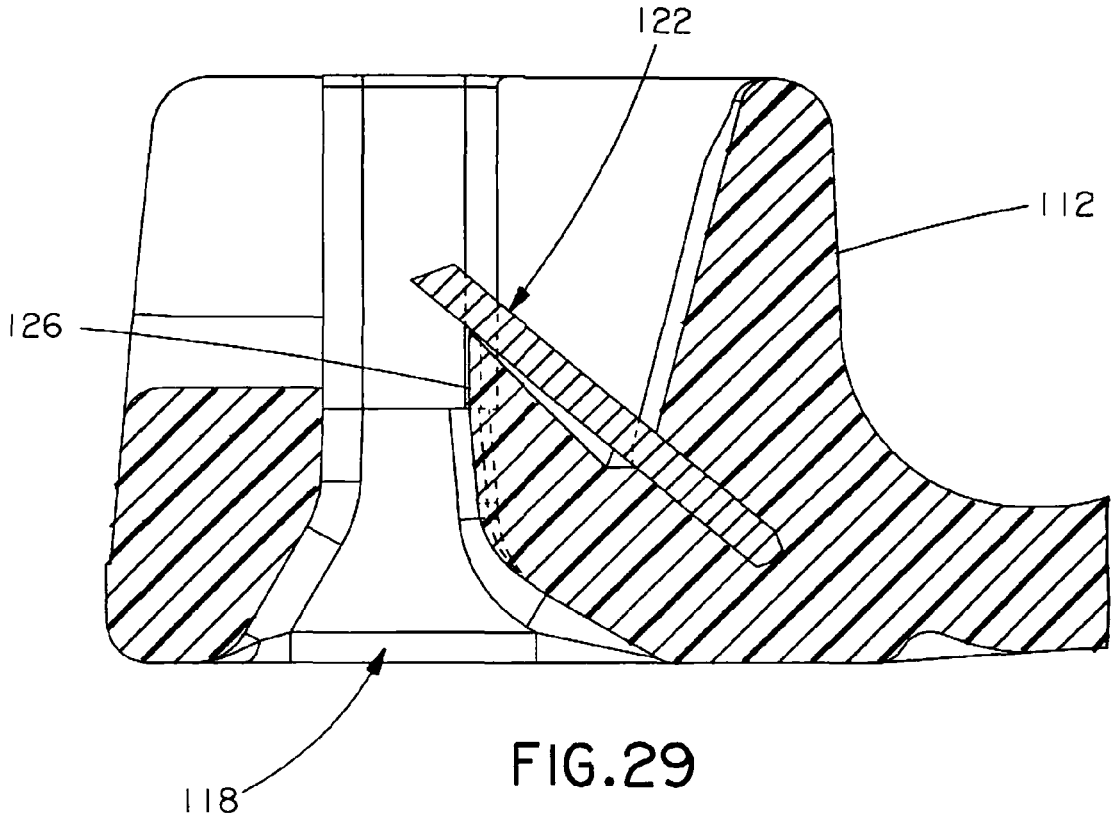
FIG. 29 is a partial cross-sectional view of an improved two-piece cable tie head in which a barb support portion is provided under the metal locking device.
Figure 30:
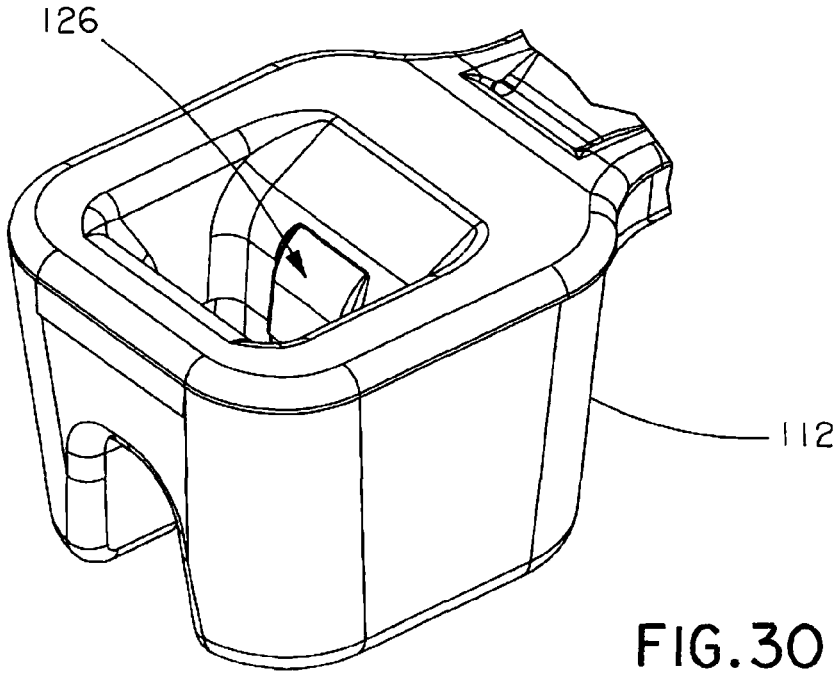
FIG. 30 is a partial bottom view of the cable tie head of FIG. 29 showing the barb support portion.

By defining window dimensions in the strap accepting channel that substantially correspond with the profile of the strap, additional support material can be provided in an area immediately underneath metal locking device 122. In particular, as shown in FIGS. 27-28, strap 114 has a minimum thickness D in a middle section and a maximum thickness C at the lateral extremities due to the rails 160. Rather than providing a square profile for the strap accepting channel 118 that is sized with a thickness A that is slightly larger than the maximum thickness C, it is possible to provide a reinforcing area 126 underneath the metal locking device 122 of a width corresponding to or slightly less than the width of the strap recess 150 that protrudes radially inward to define a center portion of the strap accepting channel 118 with a thickness of B that is slightly larger than strap thickness D, but smaller than thickness A. The additional support from reinforcing area 126 under the metal locking device 122 helps prevent barb inversion. Moreover, because the support is only located at portions corresponding to the recess 150, the localized support does not affect thread force. A preferred support has a width that extends at least the width of metal locking device 122, and preferably slightly wider as shown in FIG. 28. Additional details of the reinforcing area 126 are shown in FIGS. 29-30.

Any of the above exemplary cable ties may be used either manually or may be used in conjunction with an automated cable tie installation tool, such as the tool illustrated in FIG. 4.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

The invention claimed is:

1. A cable tie for use with an automated cable tie installation tool, the cable tie comprising:

a strap including a first end forming a neck region and a free end opposite the first end; and a cable tie head secured to the neck region of the strap at the first end of the strap, the head including a strap accepting channel containing a locking device, the strap accepting channel being sized to receive the free end of the strap, wherein the strap includes a pair of side rails and a pad extending between the side rails, the pad positioned adjacent the neck region such that the length of the pad is oriented transverse to the length of the strap, and wherein the pad is sized to fit between adjacent wires in a bundle to minimize rotation of the cable tie relative to the bundle without damaging the wires.

2. The cable tie of claim 1, wherein the pad is positioned on a side of the strap that contacts a bundle when the cable tie is applied.

3. The cable tie of claim 1, wherein the pad is positioned within a cable tie head width of the head.

4. The cable tie of claim 1, wherein the pad extends from the strap between about 0.035 inches and about 0.040 inches.

5. The cable tie of claim 1, wherein a distal surface of the pad is spaced apart from the strap and aligned with a bottom surface of the head.

* * * * *